US008461096B2

(12) United States Patent
King et al.

(10) Patent No.: US 8,461,096 B2
(45) Date of Patent: Jun. 11, 2013

(54) METHODS OF MAKING FABRIC SOFTENER

(75) Inventors: Darren Franklin King, West Chester, OH (US); Alessandro Corona, III, Mason, OH (US); Eric Foster Hopper, Deerfield Township, OH (US); Brian Christopher Groendyke, Newport, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/070,526

(22) Filed: Mar. 24, 2011

(65) Prior Publication Data

US 2011/0237490 A1 Sep. 29, 2011

Related U.S. Application Data

(60) Provisional application No. 61/317,727, filed on Mar. 26, 2010.

(51) Int. Cl.
*C11D 3/00* (2006.01)

(52) U.S. Cl.
USPC ..... 510/515; 510/287

(58) Field of Classification Search
USPC ..... 510/515
See application file for complete search history.

(56) References Cited

U.S. PATENT DOCUMENTS

| | | | | |
|---|---|---|---|---|
| 5,137,646 | A | 8/1992 | Schmidt et al. | |
| 5,476,598 | A * | 12/1995 | Schramm et al. | 510/522 |
| 5,505,866 | A | 4/1996 | Bacon et al. | |
| 8,026,206 | B2 | 9/2011 | Sajic et al. | |
| 8,080,513 | B2 * | 12/2011 | McGinnis et al. | 510/515 |
| 2002/0094943 | A1 * | 7/2002 | Liew | 510/327 |
| 2003/0060390 | A1 | 3/2003 | Demeyere et al. | |
| 2003/0126282 | A1 | 7/2003 | Sarkar et al. | |
| 2003/0195130 | A1 * | 10/2003 | Lentsch et al. | 510/327 |
| 2004/0167056 | A1 * | 8/2004 | Lentsch et al. | 510/504 |
| 2004/0204337 | A1 | 10/2004 | Corona et al. | |
| 2005/0256020 | A1 * | 11/2005 | Gardner et al. | 510/392 |
| 2005/0261157 | A1 * | 11/2005 | Haught et al. | 510/392 |
| 2006/0054193 | A1 * | 3/2006 | Van Kralingen et al. | 134/42 |
| 2006/0089293 | A1 | 4/2006 | Frankenbach | |
| 2006/0264352 | A1 * | 11/2006 | Sajic et al. | 510/515 |
| 2007/0054835 | A1 * | 3/2007 | Corona et al. | 510/515 |
| 2009/0054296 | A1 * | 2/2009 | Mohammadi | 510/522 |
| 2009/0181877 | A1 * | 7/2009 | McGinnis et al. | 510/515 |
| 2011/0219730 | A1 * | 9/2011 | Corona et al. | 53/467 |
| 2011/0237489 | A1 * | 9/2011 | King et al. | 510/515 |
| 2011/0237490 | A1 * | 9/2011 | King et al. | 510/515 |

OTHER PUBLICATIONS

In Re Van Geuns; 91/1088; United States Court of Appeals for the Federal Circuit; 988 F.2d 1181; 1993 U.S. App. LEXIS 4331; 26 U.S.P.Q.2D (BNA) 1057; Mar. 10,1993, Decided; 6 pages.

International Search Report; International Application No. PCT/US2011/029731; date of mailing Aug. 29, 2011; 4 pages.

In Re Van Geuns; 91/1088;United States Court of Appeals for the Federal Circuit; 988 F.2d 1181; 1993 U.S. App. LEXIS 4331; 26 U.S.P.Q.2D (BNA) 1057; Mar. 10, 1993, Decided; 6 pages.

* cited by examiner

*Primary Examiner* — Mark Eashoo
*Assistant Examiner* — M. Reza Asdjodi
(74) *Attorney, Agent, or Firm* — James F. McBride; Steven W. Miller

(57) ABSTRACT

Optimizing dilution processing, include the use of cold dilution water, yields fabric softener products of desired rheology and stability.

9 Claims, No Drawings

METHODS OF MAKING FABRIC SOFTENER

CROSS-REFERENCES TO RELATED APPLICATIONS

This application claims priority to and benefit of U.S. Provisional Patent Application No. 61/317,727, filed on Mar. 26, 2010.

FIELD OF THE INVENTION

The present invention relates to methods of making fabric softener

BACKGROUND OF THE INVENTION

So called "single rinse" fabric softener products have been described. US 2003/0060390. These products are generally directed to hand wash laundry applications. The "single rinse" generally indicates that the user need only use the single rinse fabric softener to rinse and soften their washed laundry with a single rinse liquor (comprising rinse water and recommend dose of fabric softener) versus having multiple rinse steps and then a final fabric softening step. There are many challenges to making and marketing such single rinse fabric softening products. These challenges include manufacturing costs, formulation costs, desired rheology, and long term phase (~1 year) stability to name a few. There is a continuing need to make fabric softener compositions that: (a) minimize components (thereby keeping raw materials costs down and reduce complexity); (b) provide consumer preferred rheology—particularly with low fabric softener active amounts (e.g., typically lower than about 7% fabric softener active); and maximize unilamellar vesicle structure of the fabric softener active as to enhance fabric softening efficiency while mitigating negative effectives of anionic carryover (i.e., from the wash liquor). Of course these needs must all be met while minimizing costs and capital expenditures. This is particularly true in developing markets. US 2006-0089293 A1; US 2009-0181877 A1; US 2007-0054835 A1

SUMMARY OF THE INVENTION

The present invention attempts to meet one or more of these needs by providing in a first aspect of the invention, a method of making a concentrated fabric softener active (CFSA) hydrate comprising the steps: providing a fabric softener active concentrate comprising a fabric softener active; providing heated water wherein the water has a conductivity between 0 and 300 microsiemens; and combining the fabric softener concentrate and the water to make the fabric softener hydrate, wherein the resultant CFSA hydrate is: substantially free of non-melted or non-hydrated softener active; comprises a temperature from 55° C. to 80° C.; and has 14% to 28% of the fabric softener active by weight of the CFSA hydrate.

Another aspect of the invention provides for a method of making a diluted fabric softening composition (DFSC) comprising from about 3% to about 10% fabric softening active comprising the steps: providing a concentrated fabric softener active (CFSA) hydrate comprising about 14% to 28% of fabric softener active by weight of the CFSA hydrate, and having a temperature from 55° C. to 80° C.; providing water wherein the water has a conductivity between 0 and 300 microsiemens; and diluting the CFSA hydrate with water to form the DFSC having about 3% to about 10% of fabric softening active by weight of the DFSC.

DETAILED DESCRIPTION OF THE INVENTION

Fabric Softener Active

An example of a single rinse fabric softener includes one manufactured by The Procter & Gamble Company under the brand DOWNY Single Rinse. Generally this product is directed to hand washing markets. So called single rinse products provide the consumer the time, cost, and water savings of a single laundry rinse that rinses detergent from the laundry washing step. Consumers are generally instructed to hand wash their laundry as they typically do. Rinsing is not needed, but rather excess detergent solution should be eliminated from the laundry. The recommended dose of Single Rinse fabric softener is added to the rinse solution and the laundry should soak for a few minutes. Laundry is then wrung and line dried.

These fabric softeners typically have about 2% to about 10%, alternatively from about 3% to about 9%, alternatively from about 4% to about 8%, alternatively 5% to 7%, alternatively from 3% to 5%, alternatively combinations thereof, of a fabric softening active by weight of the softener.

One class of fabric softener actives includes cationic surfactants. Examples of cationic surfactants include quaternary ammonium compounds. Examples of quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. Fabric softening compositions, and components thereof, are generally described in US 2004/0204337 and US 2003/0060390.

In one embodiment, the fabric softening active comprises, as the principal active, compounds of the formula (I):

$$\{R_{4-m}—N^{+}—[(CH_2)_n—Y—R^1]_m\}X^{-} \quad (1)$$

wherein each R substituent is either hydrogen, a short chain $C_1$-$C_6$, preferably $C_1$-$C_3$ alkyl or hydroxyalkyl group, e.g., methyl, ethyl, propyl, hydroxyethyl, and the like, poly ($C_{2-3}$ alkoxy), preferably polyethoxy, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, preferably $C_{14}$-$C_{20}$, with each $R^1$ being a hydrocarbyl, or substituted hydrocarbyl group, and $X^-$ can be any softener-compatible anion, preferably, chloride, bromide, methylsulfate, ethylsulfate, sulfate, and nitrate, more preferably chloride or methyl sulfate. -limiting examples of compound (1) are N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

In one embodiment, the fabric softening active has a relatively low Iodine Value (IV) such as from about 1 to about 15, alternatively from about 5 to about 12, alternatively from 6 to 10, alternatively combinations thereof. The Iodine Value is the amount of iodine in grams consumed by the reaction of the double bonds of 100 g of fatty acid, determined by the method of ISO 3961.

Hydrating Fabric Softener Active

It is surprisingly discovered that conditions in hydrating a fabric softener active to make an intermediate fabric softener hydrate may affect a final (or near final) fabric softener product. Without wishing to be bound by theory, if the fabric softener hydrate is too dilute (i.e., too low fabric softener active level in the hydrate), the final fabric softener product may not have the desired lamellar vesicle structures for providing single rinse fabric softening benefits. If the fabric softener hydrate is too concentrated, the desired viscosity profile of the final fabric softener product may not be achieved (e.g., need for thickeners to achieve the desired viscosity or a lack of pumpability (i.e., too thick) for the composition to be processed further).

The hydration conditions that may be important to yield a desirable fabric softener hydrate and ultimately a final fabric softener product may include an optimized fabric softener active concentration in the hydration composition; an optimized hydrate temperature; and/or a low electrolyte level (as measured by conductivity, e.g., <300 microsiemens) in the water used to hydrate the active.

One aspect of the invention provides for methods of making a fabric softener hydrate.

a) One step of the method provides a fabric softener active concentrate. These actives typically arrive from supplier as a concentrated paste (US 2006-0089293 A1; US 2007-0054835 A1) or solid flakes (U.S. Pat. No. 5,505,866, col. 16, 1. 55-col. 17, 1. 15) or even blocks that are ground (US 2009-0181877 A1). In one embodiment, the fabric softener active concentrate is provided as a flake, or a pellet or a chip, or a ground flake, or similar sized material as to maximize surface area for hydration (hereinafter collectively referred to a "flake"). In another embodiment, the fabric softener concentrate comprises from about 80% to about 100%, alternatively from 65% to 90%, alternatively from 75% to 95%, alternatively combinations thereof, of a fabric softener active.

b) Another step pertains to solid active hydration, to a hydrate temperature from about 55° C. to about 80° C. and wherein the water has a low electrolyte level. In one embodiment, the water temperature is from about 60° C. to about 75° C., alternatively 62° C. to 72° C., alternatively 62° C. to 68° C., alternatively combinations thereof. One way of measuring the amount of electrolyte in water is the water conductivity. In one embodiment the water comprises from about zero microsiemens to about 300 microsiemens, alternatively from about zero microsiemens to about 200 microsiemens, alternatively from about zero microsiemens to about 100 microsiemens, alternatively combinations thereof. Without wishing to be bound by theory, the electrolyte level of water can impact lamellar vesicle structures and cause finished product phase instability. One way to reduce the level of electrolyte in water is via a de-ionization system.

c) Yet another step combines the concentrate and water in a container in an amount to form a hydration composition comprising from about 14% to about 28%, or from 15.5% to 21.5%, or 16.5% to 20.5%, or about 18.4%, or combinations thereof, of fabric softener active by weight of the hydration composition. A suitable container to combine the concentrate and water may include a 15 gallon stainless steel tank.

d) Yet another step mixes the concentrate and water in the container to form the hydration composition. For the container described previously, an example of a mixing device may include a top mounted agitator with two sets of four 6-inch pitched impeller blades. Mixing is typically for about 4 minutes to 12 minutes at sufficient intensity to create a visually homogenous hydrate (without entraining excessive air).

The fabric softener hydrate comprises a final fabric softening active concentration of about 14% to about 28% by weight of the hydrate (alternatively 15.5 wt % to 21.5 wt %; or 16.5 wt % to 20.5 wt %; or about 18.4%; or combinations thereof) and a temperature of about 55° C. to about 80° C. (alternatively 60° C.-75° C., or 62° C.-72° C., or 62° C.-68° C., or about 65° C., or combinations thereof). The hydrate may be optionally milled before going to a dilution step. A suitable mill may operate with high shear speed and include three rotor-stator stages with coarse, medium, and fine grind sets.

Dilution

Another aspect of the invention comprising diluting the fabric softener hydrate (that comprises from about 14% to about 28% of fabric softener active by weight of the hydrate) to about 10% to about 3% fabric softener active with the use of chilled water (i.e., colder than ambient temperature) to surprisingly achieve desirable diluted fabric softening composition.

Conventional wisdom would suggest diluting with warm or ambient temperate water to avoid shocking the system and enable gradual formation of desirable lamellar vesicle structures. Indeed it is an added expense to chill water and the hydrate provided is about 55° C. to 80° C. However, this expense is more than off-set by the desirable viscosity and desirable unilamellar vesicle structures achieved through the use of chilled water. The resultant desirable viscosity helps minimize the use of expensive thickeners/viscosity modifiers (e.g., using about 1-2% such modifiers to less than about 0.2% if any at all in some formulations). Of course the reduction of thickeners/viscosity modifiers reduces the complexity and cost of manufacturing fabric softening formulations. In some applications, the present invention represents approximately 20 fold reduction in the amount such modifiers. Moreover, many of these compositions exhibit acceptable long-term stability. Without wishing to be bound by theory, the cold water preserves (essentially "freezes") the desirable lamellar vesicle structure. The desirable viscosity (e.g., 50 cp to 800 cp at 60 rpm and 25° C. as measured by "Viscosity Method" detailed below) may be a result of water being trapped inside the vesicles.

One step of the invention provides for providing a fabric softener hydrate comprising about 14% to 28% of fabric softener active by weight of the fabric softener hydrate, and having a temperature from 55° C. to 80° C. Alternative embodiments of the fabric softener hydrate may comprise a fabric softening active concentration of about 15.5% to about 21.5% by weight of the hydrate (alternatively 16.5 wt % to 20.5 wt %; or about 18.4%; or combinations thereof) and a temperature of about 60° C. to about 75° C. (alternatively 62° C.-72° C., or 62° C.-68° C., or about 65° C., or combinations thereof). The hydrate may optionally be milled as previously described. The fabric softener actives may include those as previously described.

Another step of the invention provides for diluting the fabric softener hydrate with chilled water (i.e., water below ambient temperature) to form a resulting diluted fabric softening composition, wherein the diluted fabric softening composition has from about 3% to about 10% of fabric softening active by weight of the composition. In one embodiment, the chilled water is at temperature as to cause the resulting diluted fabric softening composition to have a temperature at 40° C. or below (alternatively below 35° C., alternatively below 32° C., alternatively at or below 29° C., alternatively from about 1° C. to about 30° C., alternatively from 20° C. to 28° C., alternatively from 25° C. to 28° C., alternatively combinations thereof). In another embodiment, the diluting step is conducted in a batch wise process. In yet another embodiment, the diluting step is conducted in-line. The term "in-line" means that two pipes converge wherein a first pipe pipes fabric softener hydrate and wherein the second pipe pipes chilled water. A static mixer or other type mixing apparatus may be added after the fabric softener hydrate and chilled water convergence to facilitate mixing. In still yet another embodiment, the resulting diluted fabric softener composition achieves a temperature at or below 30° C. (or the other indicated alternative temperatures) within 60 seconds (alternatively within 45 seconds, alternatively within 30 seconds, alternatively with 20 seconds, alternatively 10 seconds, alternatively 5 seconds, alternatively from 0.1 second to 60 seconds, alternatively from 1 second to 30 seconds, alternatively combinations thereof). In still yet another embodiment, the resulting diluted fabric softener composition is further chilled through use of a heat exchanger to a temperature of 30° C. or below (alternatively below 25° C., alternatively at or below 22° C., alternatively from about 14° C. to about 30° C., alternatively from 17° C. to 24° C., alternatively from 18° C. to 22° C., alternatively combinations thereof). Without wishing to be bound by theory, the quicker the fabric softener hydrate is chilled with water to the desired temperature, the more desirable the resultant lamellar vesicle structures.

In one embodiment, dilution is a multiple step process and additional dilutions with water (and adjunct chemistries) are performed at some time after the initial dilution so as to enable late product differentiation and customization.

In one embodiment, the chilled water comprises from about zero microsiemens to about 300 microsiemens, alternatively from about zero microsiemens to about 200 microsiemens, alternatively from about zero microsiemens to about 100 microsiemens, alternatively from about zero to about 50 microsiemens, alternatively from about zero microsiemens to about 25 microsiemens, alternatively combinations thereof. Without wishing to be bound by theory, the electrolyte level of water can impact lamellar vesicle structures and cause finished product phase instability. One way to reduce the level of electrolyte in water is via a de-ionization system.

The resulting diluted fabric softening composition may comprise from 3% to 10% (alternatively from 4% to 10%, alternatively from 4% to 9%, alternatively from 4% to 8%, alternatively from 5% to 7%, alternatively about 5%, alternatively combinations thereof) of fabric softener active by weight of the composition.

In one embodiment, the resulting diluted fabric softener composition comprises less than 3% (alternatively less than 2.5%, alternatively less than 2%, alternatively less than 1.5%, alternatively less than 1%, alternatively less than 0.5%, alternatively less than 0.2%, alternatively less than 0.01%, alternatively from 0.001% to 0.2%, alternatively combinations thereof) of a viscosity modifier by weight of the diluted fabric softener composition. The term "viscosity modifier" means any structurant or thickener or the like with the principle objective of increasing the viscosity of the composition.

In one embodiment the resulting diluted fabric softener comprises a viscosity from 30 cp to 1,000 cp, alternatively from 100 cp to 800 cp, alternatively 150 cp to 600 cp, alternatively 30 to 500 cp, alternatively from 100 to 300 cp, alternatively from 700 cp to 1000 cp. The temperature of the softener is assessed at 25° C.

Adjunct Ingredients

Adjunct ingredients that may be added to the compositions of the present invention. The ingredients may include: suds suppressor, preferably a silicone suds suppressor (US 2003/0060390 A1, ¶65-77); cationic starches (US 2004/0204337 A1); scum dispersants (US 2003/0126282 A1, ¶89-90); perfume and perfume microcapsules (U.S. Pat. No. 5,137,646); nonionic surfactant, non-aqueous solvent, fatty acid, dye, preservatives, optical brighteners, antifoam agents, and combinations thereof. The amount of each optional adjunct ingredient is typically up to about 2%, by weight of the composition.

Viscosity Assessment Method

One way of assessing viscosity, expressed in centipoises (cP) units, is by rotational viscometry using a BROOKFIELD viscosity meter. Instruments may include Synchro-Lectic Viscometer, model LVF/LVT equipped with VL1-4 spindles and/or model RVF/RVT with RV 1-7 with spindles. The sample jar, containing the test material, is at least 3.5 times the diameter of the largest spindle used and of sufficient height to allow the spindle to be immersed in test sample to beyond the groove cut in the spindle shaft. The level of the test material is at the immersion groove cut in the spindle shaft. The viscometer is level.

Unless otherwise specified, assessment is conducted at 25° C., a spindle size that corresponds to 20 sec −1 (reciprocal seconds), and at 60 rpm. The spindle and rpm should give a reading of the centre of the scale (10 to 90% of full scale reading). The guard of the viscometer is in place during assessments. Measurement is repeated two or more time and an average result of the three measurements recorded. The percent relative standard deviation (RSD) of these three readings is determined. If the percent RSD is greater than 3%, the readings need to be repeated until acceptable. The performance of the viscometer is checked against the appropriate standards (e.g., available from BROOKFIELD). Standards are chosen having viscosity close to the test material. Any air bubbles from the test material are removed.

References include Brookfield Synchro-Lectric Viscometer Instruction Manual, and Brookfield Factor-Finder. See also, ASTM D 2196-99, Rheological Properties of Non-Newtonian Materials by Rotational (Brookfield type) Viscometer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a fabric softening composition comprising: diluting a fabric softener active hydrate having a temperature from 55° C. to 80° C. and comprising about 14% to 28% of fabric softener active by weight of the fabric softener active hydrate with chilled water having a conductivity between 0 and 300 microsiemens, so that said fabric softening composition's temperature is lowered to 40° C. within 30 seconds or less of said dilution, to form a fabric softening composition having a viscosity of 30 cp to 500 cp and comprising about 3% to about 10% of fabric softening active by weight of the fabric softening composition.

2. The method of claim 1, wherein the fabric softener active comprises a quaternary ammonium compound.

3. The method of claim 2, wherein the amount electrolytes in the water is measured by conductivity and wherein the conductivity is from 0 to 200 microsiemens.

4. The method of claim 3, wherein the step of diluting comprising an in-line process such that the temperature is lowered essentially instantaneously.

5. The method of claim 4, wherein the water conductivity is from 0 to 100 microsiemens.

6. The method of claim 5, wherein the chilled water comprises a temperature such that the fabric softening composition has a temperature lowered to 35° C. or below.

7. The method of claim 6, wherein the chilled water comprises a temperature such that the fabric softening composition has a temperature lowered to 32° C. or below, and wherein the fabric softening composition has from 5% to 9% of the quaternary ammonium compound.

8. The method of claim 7, wherein the chilled water comprises a temperature at or below 10° C.

9. The method of claim 8 wherein said fabric softening composition is essentially free of a single purpose viscosity modifier.

* * * * *